US008681068B1

(12) United States Patent
Williams et al.

(10) Patent No.: US 8,681,068 B1
(45) Date of Patent: Mar. 25, 2014

(54) HIGHLY AGILE WIDEBAND CAVITY IMPEDANCE MATCHING

(75) Inventors: Brett A. Williams, Iowa City, IA (US); Kurt S. Schuder, Dallas, TX (US); J. Michael Zamarron, Fort Worth, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 662 days.

(21) Appl. No.: 12/881,946

(22) Filed: Sep. 14, 2010

Related U.S. Application Data

(60) Provisional application No. 61/242,429, filed on Sep. 15, 2009.

(51) Int. Cl.
*H01Q 1/52* (2006.01)

(52) U.S. Cl.
USPC ..... 343/841; 343/705; 343/789; 343/895; 343/759; 342/54; 342/62

(58) Field of Classification Search
USPC ..... 343/705, 789, 841, 895; 342/54, 62
See application file for complete search history.

(56) References Cited

U.S. PATENT DOCUMENTS

| | | | | |
|---|---|---|---|---|
| 5,589,842 | A | 12/1996 | Wang et al. | |
| 5,929,430 | A | 7/1999 | Yao et al. | |
| 5,929,439 | A | 7/1999 | Todokoro et al. | |
| 6,389,197 | B1 | 5/2002 | Iltchenko et al. | |
| 6,407,721 | B1 | 6/2002 | Mehen et al. | |
| 6,473,218 | B1 | 10/2002 | Maleki et al. | |
| 7,133,180 | B2 | 11/2006 | Ilchenko et al. | |
| 7,724,179 | B2 * | 5/2010 | Williams et al. | 342/54 |
| 7,917,042 | B2 * | 3/2011 | Adamiecki et al. | 398/202 |

* cited by examiner

*Primary Examiner* — Jerome Jackson, Jr.
*Assistant Examiner* — Andrea Lindgren Baltzell
(74) *Attorney, Agent, or Firm* — Withrow & Terranova, PLLC

(57) ABSTRACT

A technique for suppressing backwaves employs a photonic approach. In one aspect, the technique includes an apparatus, including: a radiating element; and a microwave-photonic device for suppressing backwaves from the radiating element. In a second aspect, the technique includes a method for removing unwanted radiation from a radiating device, comprising: receiving unwanted radiation from the radiating device; communicating the received radiation to an electro-optically active material; communicating laser light to the electro-optically active material; communicating electromagnetic products of interactions between the radiation and the laser light to a photodiode; and communicating photodiode outputs to a termination.

15 Claims, 5 Drawing Sheets

HIGHLY AGILE WIDEBAND CAVITY IMPEDANCE MATCHING

CROSS-REFERENCE TO RELATED APPLICATIONS

The priority of U.S. Application Ser. No. 61/242,429, entitled "Highly Agile Wideband Cavity Impedance Matching", and filed Sep. 15, 2009, in the name of the inventors Brett A. Williams, et al. is hereby claimed under 35 U.S.C. §119(e). This application is also hereby incorporated by reference for all purposes as if set forth verbatim herein.

STATEMENT REGARDING FEDERALLY SPONSORED RESEARCH OR DEVELOPMENT

Not applicable.

BACKGROUND OF THE INVENTION

This section of this document introduces various aspects of the art that may be related to various aspects of the present invention described and/or claimed below. It provides background information to facilitate a better understanding of the various aspects of the present invention. As the section's title implies, this is a discussion of "related" art. That such art is related in no way implies that it is also "prior" art. The related art may or may not be prior art. The discussion in this section of this document is to be read in this light, and not as admissions of prior art.

So-called super-thin frequency independent antennas, while having thin profiles suitable for missile surface conformal placement reducing volume demands, also have narrow bandwidth coverage for antenna types that are supposed to be "frequency independent" but are not.

Spirals antennas are known for much greater bandwidth, typically in practice 2-18 GHz. Spiral antennas are desired for their frequency independence in terms of impedance and antenna power pattern behavior (beamwidth, gain, etc.). Relative invariance in their antenna patterns over this region makes them attractive for passive reception of active sources over broad frequency ranges. Thin designs are dependent on and constricted by fixed circuit elements tuning their resonant RF cavity. It is this static lumped element technology that confines thin spiral bandwidths.

In the past deep cavities have been used on standard spiral antennas. Their cavities are set to a depth equal to one-quarter wavelength of their lowest frequency. Thus, at 2 GHz, a 1.5" deep cavity is required far in excess of our volume allowance constrained by volume starved missiles. Some super thin cavities have also been employed with narrow bands (300 MHz compared to standard 16 GHz bands for typical spirals). Both are means of capturing and removing backwaves from the radiating element. While this latter means allows super thin spirals to operate (albeit over narrow band) thus providing their thin packaging advantage, it does not serve the broad frequency band desires expected of typical frequency independent spirals.

Whether cavities or lumped elements are employed, both act as a type of filter for their associated antenna, allowing undisturbed reception of frequencies within their bandpass while attenuating those frequencies outside their designed band. In this case the effect of out-of-band attenuation is to reduce antenna directivity. Out-of-band frequencies will cause the antenna backwave to destructively interfere with the forward propagating wave thereby reducing antenna mainbeam gain.

Most tunable RF filters fall into three basic types: mechanically tunable, magnetically tunable and electronically tunable filters. Mechanically tuned RF filters have large power handling capability, low insertion loss, tend to be large, heavy and switch at slow speeds. Magnetically tunable RF filters like YIG filters often used between 0.5-18 GHz are smaller, have moderate insertion loss (~6 dB), moderate tuning speeds (2 GHz/ms) and require tuning currents of hundreds of milliamps. Electronically tunable RF filters are faster, smaller and adjust by variation in voltage, changing a capacitor's capacitance within the resonator (via varactor diodes, which are nonlinear and thus create intermod products; ferroelectric thin films, which are also nonlinear; or MEMS, switches/varactors). All have relatively narrow bandwidths, thus banks must be assembled to accommodate wide bands.

The present invention is directed to resolving, or at least reducing, one or all of the problems mentioned above.

SUMMARY OF THE INVENTION

A technique for suppressing backwaves employs a photonic approach in both a method and an apparatus.

In a first aspect, the apparatus is a microwave-photonic device for removing unwanted radiation from other radiating devices, comprising: means for receiving unwanted radiation; an electro-optically active material; means for communicating the received radiation to the electro-optically active materials; means for communicating laser light to the electro-optically active material; a photodiode; means for communicating electromagnetic products of interactions between radiation and laser light to a photodiode; and means for communicating photodiode outputs to a termination.

In a second aspect, the method is for removing unwanted radiation from a radiating device, comprising: receiving unwanted radiation from the radiating device; communicating the received radiation to an electro-optically active material; communicating laser light to the electro-optically active material; communicating electromagnetic products of interactions between the radiation and the laser light to a photodiode; and communicating photodiode outputs to a termination.

In a third aspect, the apparatus is a microwave-photonic device, comprising: a tunable cavity capable of receiving backwaves; an electro-optically active material into which the received backwaves are communicated; a conductor capable of communicating the received backwaves into the electro-optically active material; a prism through which laser light is communicated to the electro-optically active material; a photodiode; means for communicating electromagnetic products of interactions between radiation and laser light to a photodiode; and means for communicating photodiode outputs to a termination.

In a fourth aspect, the apparatus, comprises: a radiating element; and a microwave-photonic device for suppressing backwaves from the radiating element.

In a fifth aspect, the apparatus is an antenna, comprising: a radiating element; and means for suppressing backwaves from the radiating element.

In a sixth aspect, the apparatus is a missile, including: a plurality of spiral antennae mounted forward in the fuselage; and a backwave suppression mechanism for suppressing backwaves from the spiral antennae, each backwave suppression mechanism; and a guidance and navigation control system for guiding the missile responsive to information obtained through the spiral antennae.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which.

Figure 1:
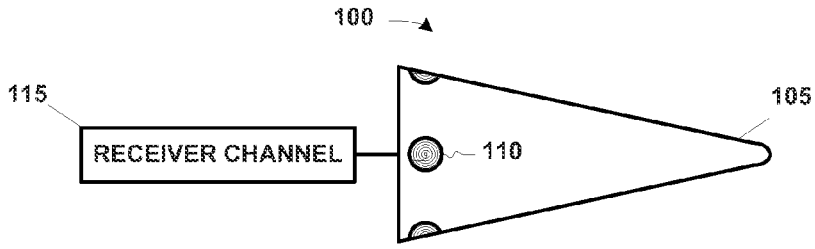
FIG. 1 conceptually illustrates one particular embodiment of an apparatus implementing the presently disclosed technique.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The presently disclosed technique employs a photonic approach to the suppression/mitigation/dampening of undesirable radiation—i.e., backwaves—from a radiating element, or antenna, such as a spiral antenna. In some embodiments, the photonic element is tunable across a wide range of frequencies. More particularly, it presents a microwave-photonic device which tunes a thin cavity behind a spiral antenna in order to damp or ground backward transmitted waves from the antenna which would otherwise interfere with it after reflection. The cavity serves to absorb this backwave allowing proper operation of the antenna in its forward direction. The cavity is tuned by the tuning/resonance/filter action disclosed herein. While lumped elements used in conventional practice have a stationary resonant band within which they reside, photonics devices may vary.

Of primary utility is the ability of photonic devices to move their passband over broad RF ranges (which are rather small at optical), in effect adjusting their impedance, thus resonant at different RF frequencies over the band for which they are tuned. While the conventional lumped element approach may be seen as a fixed filter, the present approach may be viewed as employing a roaming filter, placed in steps or continuously over a 2-18 GHz band, thereby tuning the associated antenna cavity such that well-behaved antenna patterns are allowed within the bandwidth of interest at high tuning speeds.

The presently disclosed technique provides not only full coverage of this band, but does so in a manner highly agile anywhere within the band, with a selectivity allowing avoidance of unwanted frequencies as antenna patterns decay where the cavity is not tuned; and in a small form factor without banks of filters required to cover a full range, including micro-electro-mechanical systems ("MEMS") technology due to their individual narrow bandwidths. While this dynamic impedance adjustment method is applicable to any tuning application we focus on its use in a so-called periodic antenna such as spirals, sinuous, modulated-arm-width, etc.

FIG. 1 depicts an apparatus 100 in accordance with one particular embodiment of the present invention. The apparatus 100 includes a radome 105 and a plurality of conformal, spiral antennae 110 mounted in the radome 105. The number of antennas 110 is immaterial to the practice of the invention. The antennas 110 may be implemented as discussed below relative to FIG. 2A-FIG. 2C. The apparatus 100 also includes a receiver channel 115 such as that discussed further below relative to FIG. 3-FIG. 4.

In one particular embodiment, the antenna is a spiral antenna such as that shown in U.S. Pat. No. 6,407,721, entitled "Super Thin, Cavity Free Spiral Antenna", issued Jun. 18, 2002, to Raytheon Co. as assignee of the inventors Mike Mehen et al. ("Mehen"). Mehen also discloses an RIX tuning circuit that is modified in accordance with the presently disclosed technique. In particular, the RLC tuning circuit in Mehen is replaced by a photonic element described further below.

Frequency independent antennas such as the various classes of spirals of interest here are desirable for their near-circular polarization (avoiding rejection of cross polarized linear), wide bandwidths (accepting signals over a wide range of frequencies), general power pattern independence, and conformal nature of microstrip designs, Typical off the shelf spirals come with relatively deep cavities (0.5"-2"), backing the antenna itself. This volume demand is excessive for limited real-estate applications such as in missiles. However, this cavity accommodates the antenna which radiates in both directions normal to its planar surface. Radiation in the unwanted backward direction presents a form of self-interference through backscattering in the forward direction, hampering clean operation of the device.

Placement of a cavity backing one-quarter wavelength ($\lambda/4$) from radiating spiral arms allows for a 180° path length phase shift with an additional 180° induced by E-field-vector flipping at the conductive wall, thereby satisfying boundary conditions requiring zero field on a conductor. Net phase adjustment upon return to the antenna is then 360° making return waves in-phase with radiating elements in keeping with image theory. However, the benefit of wideband periodic-spiral operation also means a variety of wavelengths must be accommodated, while the cavity wall is fixed at some distance, thereby ensuring a narrow band device because the cavity satisfies ideally only one frequency. Hence these cavities are typically loaded with absorber meant to remove interfering RF, not simply reflect in phase radiation. Cavity depth thus becomes a primary obstacle for radome surface mounting.

Figure 2A:
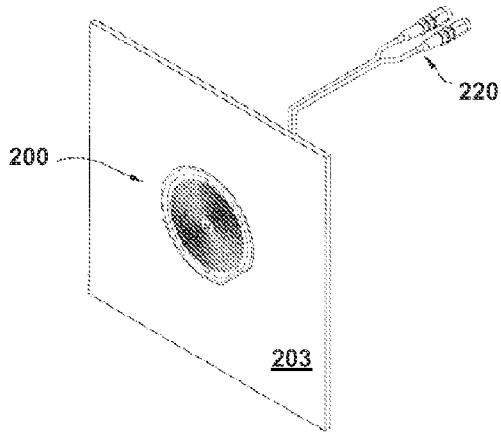
FIG. 2A-FIG. 2C illustrate the construction of one particular embodiment of the spiral antenna.
Figure 2B:
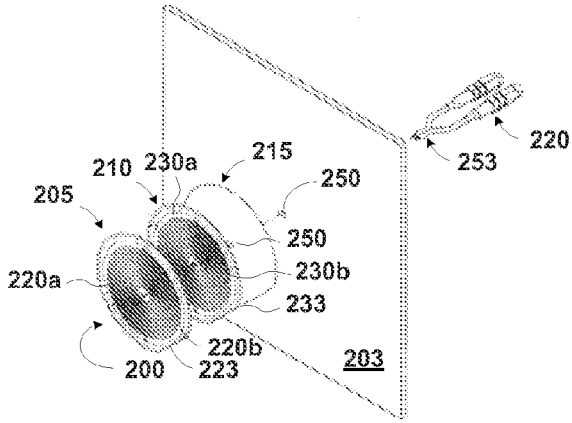
Figure 2C:
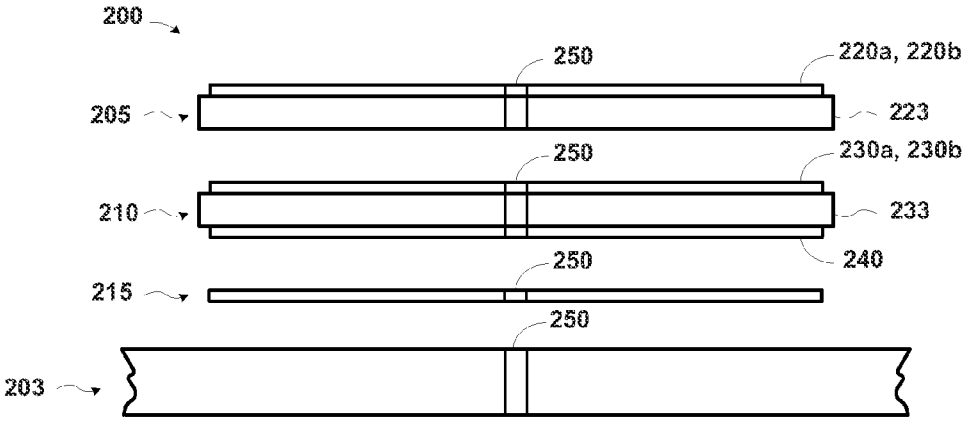

An exemplary spiral antenna 200 with reduced cavity, adapted from the disclosure of U.S. Pat. No. 6,407,721 ("Mehen et al"), is shown in FIG. 2A-FIG. 2C. The antenna 200 is mounted on an electrically conductive surface 203. The antenna 200 is made up of a plurality of thin layers 205, 210, 215. These layers, when combined, form a super thin antenna having a very low profile on the surface 203. This reduces space occupied by the antenna 200 and provides a very low aerodynamic drag coefficient for those applications which require minimum drag. Note the connectors 220 by which the antennae output may be communicated to the guiding means of the missile.

Specifically, the antenna 200 includes multiple layers representing a radiating element 205, a resonant ground plane 210, and an insulator 215. As will be described in more detail below, the radiating element 205 includes spiral radiators which serve to radiate/receive a high frequency signal. The resonant ground plane 210 includes a corresponding set of spiral radiators which form a tuned resonant circuit and set up a capacitive ground plane relative to the radiating element 205.

Since the resonant ground plane 210 resonates, the resonant ground plane 210 appears to the radiating element 205 as if the resonant ground plane 210 was located much further away from the radiating element 205 than in reality. As a result, the resonant ground plane 210 allows the radiating element 205 to radiate in a microstrip mode rather than a stripline mode. Consequently, all the energy is launched directly off the antenna 200 in a direction away from the surface 203 when transmitting.

The insulator 215 is a very thin RF-invisible electrically insulative layer which prevents the resonant ground plane 210 from being shorted directly to the surface 203. The surface 203 as shown in FIG. 2C is substantially larger than the antenna 200. However, it will be appreciated that the approximate circumference of the antenna 200 need not be more than about one lambda (1λ), where is the wavelength of the lowest operating frequency of the antenna 200.

Turning now to FIG. 2C, three spirals separated by dielectric are provided. The first is that of the free-space coupling antenna with two spiral arms 220*a*, 220*b*. The second set of conducting arms 230*a*, 230*b*, separated from the first pair 220*a*, 220*b* by a dielectric 223, is a copy of the first, coupled to a fifth arm 240 printed on a second dielectric 233 separation. These final two spiral structures 230*a*, 230*b* and 240 are connected by capacitive and inductive elements (also not designated), thus constituting a resonant cavity effectively absorbing radiated RF from the primary antenna, reducing the usual interference.

As for a conformal surface, the cones of revolution upon which the spirals lie retain their properties upon distortion, such as flattening of a conical spiral into a planar one. While some property disturbance is anticipated this implies the curved surface of a radome remains suitable. Mehen also anticipates placement of such a device inside missiles and on contoured surfaces such as an aircraft fuselage. U.S. Pat. No. 5,589,842 notes experimentation with curved surface (half cylinder) placement resulting in adjustments to voltage standing wave ratio ("VSWR") depending on bandwidth. Here, VSWR=1.5 for 330% bandwidth, VSWR=2.0 for 590% bandwidth, where this definition of bandwidth is as a factor over minimum frequency, i.e. 900% bandwidth of a 2 GHz device is 9*2=18 GHz.

Although not shown in FIG. 2C, various layers of RF-transparent adhesive may be interspersed between the respective layers 205, 210, and 215 in order to bond the assembly into a single laminate structure 200. The antenna 200 may then be mounted directly to the surface 203. As best shown in FIG. 2C, each of the layers 205, 210, and 215 and the surface 203 include appropriate electrically isolated vias or through holes 250 which permit the coaxial feed lines from the antenna cabling 253 to be coupled to the spiral arms 220*a*, 220*b* from a back side of the surface 203.

Thus, referring to FIG. 2A-FIG. 2B, the antenna 200 generally comprises a radiating element 205, a resonant (capacitive) ground plane 210, a conductive surface 203 of the carrier vehicle, and an RF-invisible insulator 215. Referring to FIG. 2B-FIG. 2C, The radiating element 205 includes the conductive spirals 220*a*, 220*b* and the dielectric layer 205. The resonant ground plane 210 includes front and back spirals 230*a*, 230*b* and 240 separated by the dielectric middle 233. The resonant ground plane 210 allows radiation in a microstrip mode, away from the first surface rather than bi-directionally in a stripline mode. The insulator 215 (0.002" thick) prevents the resonant ground plane 210 from being shorted to the electrically conductive surface 203. The resonant ground plane 210 appears electrically much further away than it is in practice.

Figure 3:
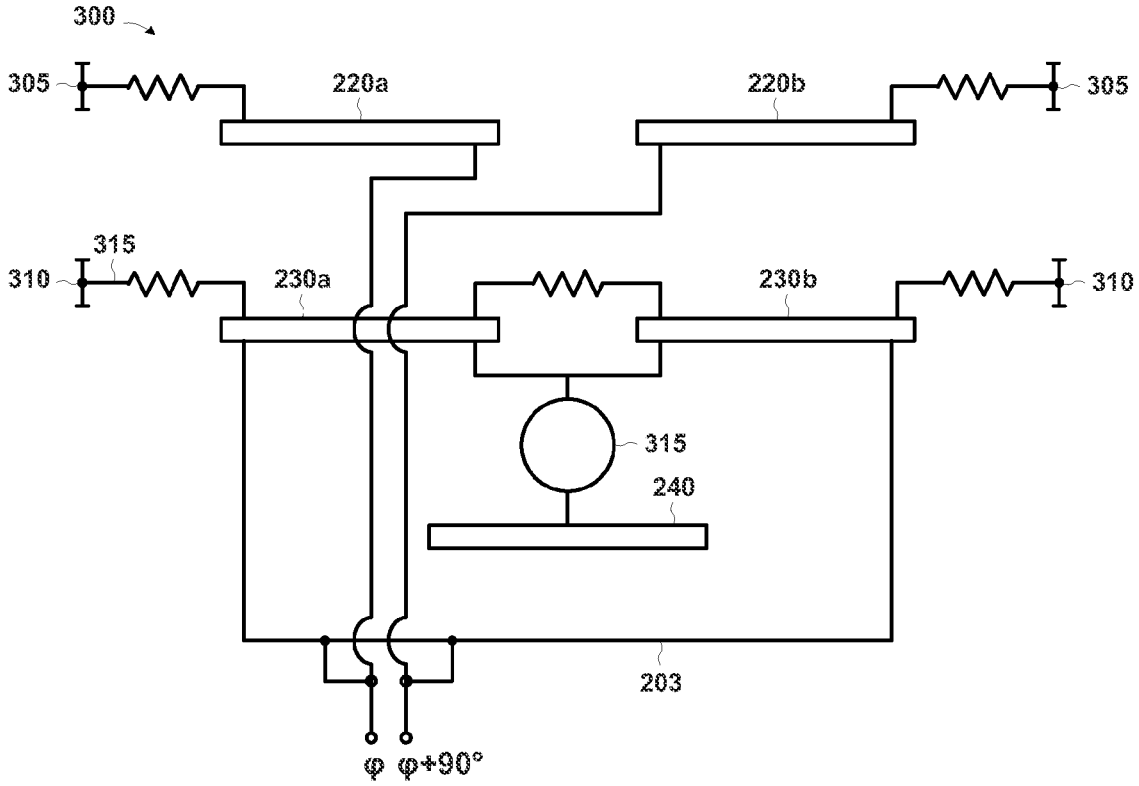
FIG. 3 is a circuit diagram for the antenna circuit of the embodiment of FIG. 1.

The presently disclosed technique leverages innovations for thin surface-mounted, spiral antennas such as the one described above to overcome cavity depth issues while extending them to our full band of interest through the antenna circuit described below. FIG. 3 discloses the antenna circuit 300. The spiral arms 230*a* and 230*b* and spiral arm 240 are electrically connected together by one or more impedance elements to form a tuned circuit designed to resonate at the operating frequency of the antenna 200. The counter-wound radiating spirals 220*a*, 220*b* have a 90° phase difference between them. The spirals 220*a*, 220*b* and 230*a*, 230*b* are grounded to respective grounding rings 305, 310, not otherwise shown. The 5th spiral arm 240 has no termination resistors to the grounding ring 310 as do the other arms, and thus floats electrically.

The presently disclosed technique replaces the reactive elements used in conventional practice with a photonic device 315. With four antennas on a missile body, and variations expected between photonic devices, this technique uses one photonic unit to serve all four antennas with their connections accounted for in the total impedance of this arrangement (although one photonic device per antenna could be employed for single antenna applications or all four coordinated for multiple antenna applications). The photonic device 315 is an adjustable photonic filter whose sweep is controlled externally by voltage bias across a microdisk as described further below.

The photonic element may be one such as is disclosed in U.S. Provisional Application Ser. No. 61/052,810, entitled, "Radio Frequency Photonic Transceiver", filed May 13, 2008, in the name of the inventors Brett A. Williams and Kurt S. Schuder ("the '810 application"). Indeed, the tuning circuit used herein is a simplified version of the receive side of the transceiver disclosed therein. The transmit side is not material to the presently disclosed technique. In the widely tunable embodiment, the tuning is accomplished through control of the DC bias across the photonic element as described in the '810 application. To further an understanding of the present invention, portions of the '810 application will now be excerpted.

The photonic device 315 of the illustrated embodiments is a microstructure, and, more particularly, a microdisk. Note that the invention is not limited to disks and disk-like geometries. Other geometries have been developed and may be satisfactory for some embodiments. For example, microspheres, micro-rings, and micro-octagons have been developed. In general, however, microdisks have, to date, demonstrated superior performance in a wider range of conditions than these other geometries. The invention therefore is not limited to microdisks as the invention admits variation in this aspect of the invention.

Suitable microdisks are commercially available on specification from, for example, OEwaves, Inc., at 1010 East Union Street Pasadena, Calif. 91106; telephone: (626) 449-5000; facsimile: (626) 449-1215; or electronic mail: info@oewaves.com. Additional information is also available over the World Wide Web of the Internet at http://www.oewaves.com/index.html.

Design of the microdisk includes material selection, diameter, thickness and polishing of the outside perimeter. Disk diameter is made to accept the RF frequency of interest by the equation $$FSR \sim \frac{c}{n_{disk} 2\pi R}$$

where:

FSR is free spectral range, or the RF frequency to which one wants to design;

c is the speed of light;

$n_{disk}$ the disk resonator refractive index; and

R its radius.

The thinner a disk the more sensitive it becomes to a fixed applied voltage because modulation index, or disk sensitivity, depends on thickness by:

$$\text{sensitivity} \sim \frac{V}{d}$$

where:

V is applied RF voltage; and d is disk thickness.

Optical polishing of the outer perimeter of the disk improves Q, i.e., narrow bandwidth. A number of materials may be selected, some better than others, as long as they are electro-optically active. A list materials from http://www.kayelaby.npl.co.uk/general_physics/2__5/2__5__11.html includes $C_6H_5O_2N$ (nitrobenzene), $Pb_{0.814}La_{0.124}$–$(Ti_{0.6}Zr_{0.4})O_3$ (PLZT), β-Zns, ZnSe, ZnTe, $Bi_{12}SiO_{20}$, $KH_2PO_4$ (KDP), $KD_2PO_4$ (KD*P), $CsH_2AsO_4$ (CDA), $BaTiO_3$, $SrTiO_3$, $KTa_{0.35}Nb_{0.65}O_3$ (KTN), $Ba_{0.25}Sr_{0.75}Nb_2O_6$, $LiNbO_3$, $LiTaO_3$, $Ag_3AsS_3$, and $KNbO_3$.

The basic process makes use of the electro-optic effect in which an RF voltage applied to an electro-optic material causes it to vary index of refraction at the rate of the RF oscillation. When laser light is coupled into the material and it is properly shaped such that this laser light proceeds on a continuous path allowing interaction with applied RF voltage—such as a disk allows when laser light cycles about its internal perimeter—then this laser light is modulated by index variation. In the case presented here, this modulation is simply a continuous or pulsed RF frequency tone.

Microdisks of the type shown and other, alternative structures, are known to the art. Principles of design, construction, and operation appear in the patent literature. For example, such information is disclosed in U.S. Pat. No. 5,929,430; U.S. Pat. No. 6,389,197; U.S. Pat. No. 6,473,218; and U.S. Pat. No. 7,133,180. Selected portions of U.S. Pat. No. 6,473,218 shall now be excerpted with some modification to further an understanding of the photonic device 315.

Figure 4:
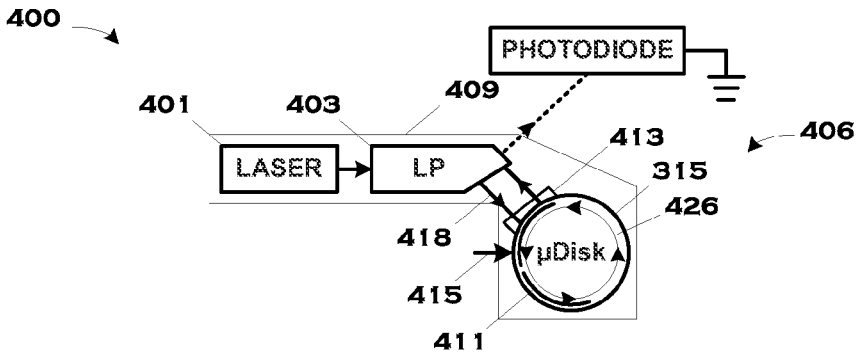
FIG. 4 depicts a portion of the receiver channel of the embodiment of FIG. 1 illustrating the implementation of the photonic device in the antenna circuit of FIG. 3.

The microdisks are formed from what are known as "whispering-gallery-mode resonators." Referring now to FIG. 4, a portion of a single channel receiver 400 employing the photonic device 315 is shown. The photonic device 315 comprises a resonator 315 modulated by an electrode 411 by a wavelocker 409, the wavelocker 409 comprising a laser 401 and a collimating lens and prism package 403. Note that some embodiments may employ only the laser 401. The optical energy from the input laser beam 418 is coupled to a resonator 315 in the whispering gallery mode through a microprism 413. The applied electrical signal—i.e., the RF input signal 415—modulates the dielectric constant of the resonator 315 and hence the phase of optical energy cycling about the disk. This modulation creates RF sidebands on the optical carrier.

In the illustrated embodiment, the whispering-gallery-mode resonator 315 defines a disk cavity. Optical energy can be coupled into a resonator 315 by evanescent coupling, e.g., using an optical coupler near the microdisk by less than one wavelength of the optical radiation. The resonators may be designed to have a high quality factor, Q, that are only limited with attenuation of radiation in the dielectric material and surface inhomogeneities.

The resonator 315 may be formed from any electro-optic material such as lithium niobate or a similar electro-optic crystal. The whispering gallery modes essentially exist near the equator of the resonator 315, the resonator 315 is a portion of the sphere near the equator that is sufficiently large to support the whispering gallery modes. Hence, rings, disks and other geometries formed from spheres may be used.

Figure 5A:
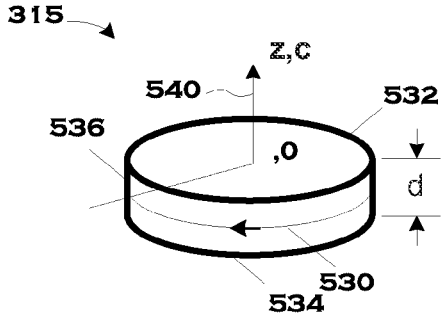
FIG. 5A-FIG. 5E illustrate the construction and the principle of operation for the photonic device in the antenna circuit of FIG. 3.

FIG. 5A shows a disk-like whispering gallery mode resonator 315 such as that used in the illustrated embodiment. It is formed from a sphere (not shown) by removing top and bottom portions of the sphere to leave a portion containing the sphere equator 530. This embodiment of the resonator 315 includes a top circular surface 532 and a bottom circular surface 534, both with diameters less than the diameter of the original sphere. The side surface 536 may be a spherical surface. The spacing, d, between the top and bottom surfaces 532 and 534 is sufficiently large that the optical and electrical modes centered at the equator 530 remain essentially undisturbed by the geometry. A small spacing d can be used to achieve a sufficient electrical field strength for the electro-optic modulation at a low voltage, e.g., on the order of millivolts.

Figure 5B:
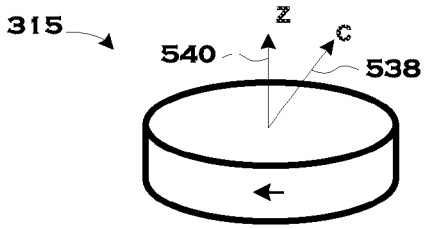

FIG. 5B shows a disk configuration where the optical c-axis 538 is different from the z-axis 540 perpendicular to the equatorial circular plane. In certain applications, the optical c-axis 538 may be aligned with the z-axis 540 as in FIG. 5A.

The optical modulator 530 in FIG. 5A-FIG. 5B may support RF (i.e., mm and microwave) signals, and light, simultaneously in a sphere of material with the electro-optic effect. Lithium niobate, for example, changes its real part of the index of refraction in response to the applied electric field. Other materials may respond to the electric field differently. Multiple quantum well structures of III-V compounds, for example, change their imaginary part of the index of refraction when the electric field is applied.

Figure 5C:
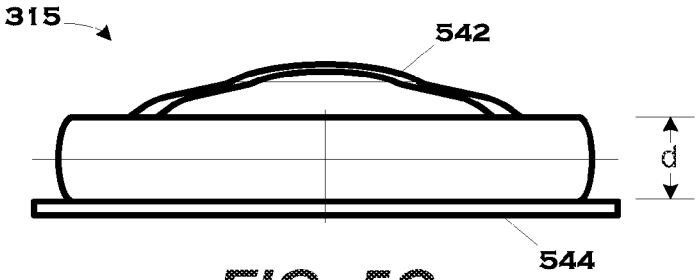
Figure 5D:
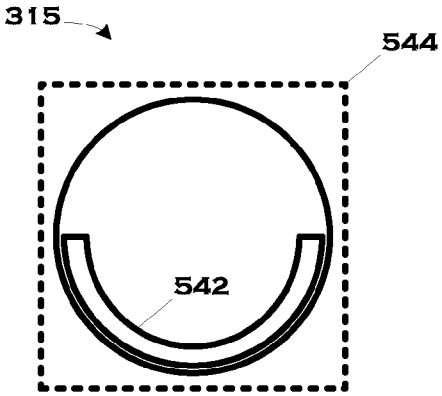
Figure 5E:
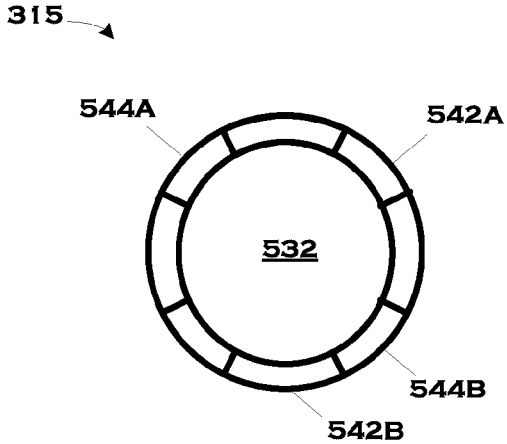

FIG. 5C-FIG. 5E show examples of the microstrip line electrode 542 when the resonator 315 is similar to the disk configuration shown in FIG. 5A and FIG. 5B. In FIG. 5C, the electrode 542 is formed on the top surface of the resonator 315 and another electrode 544 is formed in contact with the bottom surface of the resonator 315. FIG. 5D shows a half-circuit microstrip line as the top electrode 542 on the rim of the top surface. FIG. 5E shows two pieces of circular microstrip lines 542A and 542B (solid lines) as the top electrode 542 and two pieces of circular microstrip lines 544A and 545A as bottom electrodes (broken lines with shades).

Returning to FIG. 4, the single channel receiver 400 comprises a fixed and tuned microwave-photonic element 315. In this particular embodiment, the photonic element 315 acts only as a filter, leveraging the super high Qs ($10^8$-$10^9$) available through electro-optically active materials (e.g., litium niobte, lithium tantilate) in the form of resonant microdisks. The photonic device 315 is, more particularly, an electro-optically active microdisk resonator. Electro-optic activity means the material is sensitive to changing voltage, responding by a material change in refraction index.

With a laser signal evanescently wave coupled via prism coupler to the disk's internal peripheral whispering gallery mode, injected RF (radio frequency) signals which modulate the disk index thereby modulate internal laser light at the RF frequency. Resulting sidebands at optical frequencies impinge on a photodiode which also acts as a photomixer through its second order non-linearities resulting in sum and difference frequency products, whereupon those difference frequency terms pass through the photodiode and the transimpedance amplifier's own filtering action. (Both microdisk and photodiode double as mixer and filters, the microdisk is a filter at RF frequencies, the photodiode at baseband or intermediate frequencies.)

FIG. 4 shows an RF resonator attached to the microdisk, an element which must be carefully designed in order to communicate RF over the full band of interest. Laser light enters a microprism, is totally internally reflected generating evanescent waves which then allow proper coupling into the microdisk (direct laser illumination of the disk will not properly couple to the disk), as that light cycles about the inside disk perimeter modulated by input RF communicated to the disk via RF resonator thereby creating RF sidebands on an optical carrier, whereupon only RF satisfying our microdisk bandwidth is passed, as light then exits the microdisk via coupling to microprism, strikes a photodiode where it is heterodyned with available tones and filtered, ending up, in the case shown by FIG. 3 where it is then grounded.

In summary several modes of operation have been described including a multidisk option which filters RF sidebands translated to optical frequencies then acts as a cavity tuning or grounding device; a cavity tuning option where trapped energy is routed to suitable termination of the cavity through use of a single microdisk; and a simplified microwave-photonics version where one portion of the cavity in the form of receiving spiral arms identical to those which are intended to radiate instead receive a backwave from radiating arms, pass that energy to a single microdisk HAWCI unit which routes signals to ground. Options for multiple microdisk designs of two or more, connected in various fashions familiar to the art; tuned by voltage bias, temperature or other means familiar to those in the field are all similar means to the same end.

The device in FIG. 4 has a fixed frequency and bandwidth. However, the very same microdisk may be tuned over RF frequencies, adjusting its filter and center frequency by application of a DC bias across the disk.

Figure 6A:
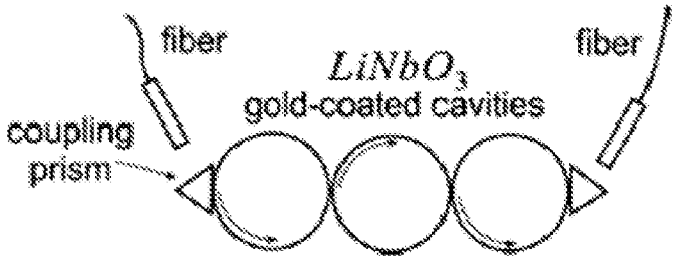
FIG. 6A-FIG. 6B illustrate a multi-disk implementation in one alternative embodiment of the present invention.
Figure 6B:
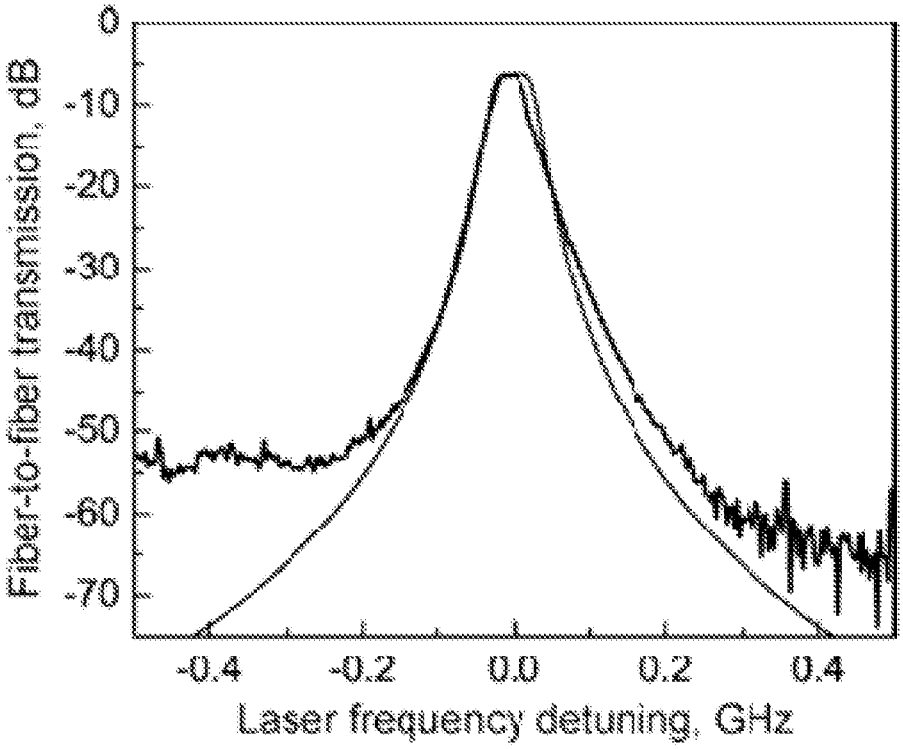

FIG. 6A-FIG. 6B illustrate a multi-disk filter and its associated 30 MHz RF bandwidth response, respectively. This device tunes over 12 GHz in 30 ns with 80 MHz/V applied or 150V for the RF range noted. This device assumes RF frequency information has already been imposed on an optical signal which is then filtered at these narrow bands. While such a filter option remains one option for some embodiments when used to tune spiral cavities it would require addition of the device shown in FIG. 4 to convert RF wavelengths to those of laser wavelengths carried by the fibers shown in FIG. 6A-FIG. 6B.

In the illustrated embodiment, the photonic device 315 is built to a specific RF bandwidth. It receives both RF input from the outside world (the backwave from the antenna) and laser input from an internal diode laser. The mixing action that takes place is only between that of RF input over the band and laser light, resulting in optical output coupled back through the microprism onto a fiber optic line or freespace guided (as in FIG. 4) to a photodiode.

Tones available for mixing on the photodiode surface are RF sidebands above and below the laser carrier (separated from it by the RF frequency) and the carrier itself. Second and third order intermodulation theory of a nonlinear device shows that sums and differences of each tone and sums and differences of multiples of each tone are created. Eq. (1) and Eq. (2) show $2^{nd}$ and $3^{rd}$ order intermodulation results for the classic two-tone case, where the symbol $\phi$ represents RF frequency with A & B representing the two tone amplitudes, v is signal voltage and the lowercase "a" is a coefficient dependent upon the device's $2^{nd}$ and $3^{rd}$ order intercept points as defined by the manufacturer (usually of nonlinear units like amplifiers and mixers including photodiodes).

$$a_2 v_{in}^2 = a_2\left(\frac{A^2+B^2}{2} + \frac{A^2}{2}\cos 2\varphi_a(t) + \frac{B^2}{2}\cos 2\varphi_b(t) + AB[\cos(\varphi_a(t)+\varphi_b(t)) + \cos(\varphi_a(t)-\varphi_b(t))]\right) \quad (1)$$

$$\begin{aligned} a_3 v_{in}^3 = {} & a_3((3A^3 6AB^2)\cos\phi_a(t) + (3B^3 + 6A^2B)\cos\phi_b(t) + \\ & 3[A^2B\cos(2\phi_a(t)-\phi_b(t)) + AB^2\cos(\phi_a(t)-2\phi_b(t))] + \\ & 3[A^2B\cos(2\phi_a(t)+\phi_b(t)) + AB^2\cos(\phi_a(t)+2\phi_b(t))] + \\ & A^3\cos 3\phi_a(t) + B^3\cos 3\phi_b(t)) \end{aligned} \quad (2)$$

What frequency products result depends on the band setting. For example if an unbiased band resides at a center frequency of 2 GHz with a 10 MHz bandwidth, while simultaneously the spiral antenna is driven by a 2 GHz signal (received or transmitted), then a backwave at 2 GHz is received by the RF cavity, passed by the apparatus and mixed upon an optical carrier of, say 200 THz, whereupon the RF signal is translated up to 199.998 THz (2 GHz below 200 THz) and 200.002 THz (2 GHz above 200 THz). The only tones available for mixing with each other on the photodiode surface are then 199.998 THz, 200.002 THz, and 200 THz. Their differences span from 0 Hz DC, 2 GHz to 4 GHz, while their sums extend all the way up to three times the highest input frequency to our diode, or 600.006 THz as a $3^{rd}$ order intermod term.

In some embodiments, Ka-band diodes and higher are used in some applications (known as RF photodiodes), as are low-pass photodiodes allowing only MHz frequency signals to pass. If a 10 MHz photodiode were used for the situation just described, no RF would pass, all would be filtered out, seen as a slight noise elevation in the photodiode bandpass. Were the photodiode band 10 GHz, then all low frequency difference terms would pass (DC, 2 GHz, 4 GHz), while all sum terms and harmonics would be filtered out. In the case where one desires to create cavity resonance, or as another option to ground out these signals, they would be absorbed by the ground plane or suitable termination of the cavity, shown at 315 in FIG. 3.

Note that the present disclosure employs the term "cavity" in accordance with the usage accorded to it by those skilled in the art. That usage includes the notion of a "cavity" in its vernacular sense—i.e., an enclosed void defined by the enclosing structure. However, as a term of art, the term "cavity" also includes stacked plates such as those used in Mehen. This is more particularly referred to as a "tuned cavity" even though there is no void, or "cavity" in the vernacular sense. (Note that Mehen therefore uses the term "cavity" only in its vernacular sense and not as those in the art would use it.)

Frequency independent antennas such as spirals, radiate both outward toward free space and backward, otherwise into our missile body volume. Typically these backwaves are captured by deep cavities loaded with radar absorbing materials (usually 1.5-2 inches deep). HAWCI acts as an RF cavity tuning device over broad frequency range, terminating the backwave which would otherwise destroy performance of the radiating antenna.

Thus, in the illustrated embodiment, the apparatus is a microwave-photonic device that is not only miniature in size (e.g., 13 mm×13 mm×4 mm), but it is also agile, roaming over the entire 2-18 GHz band desired at high speed (30 ns to 1 ms) via continuous tuning or steps as dictated by simple DC voltage across the microdisk core. The package positives of super thin spirals may therefore be accessed and their bandwidths expanded to accommodate the wide spectrum of target threats from S and C band to Ku all accessed by a single antenna that sits on a radome surface.

The embodiments illustrated herein employ the presently disclosed photonic suppression technique for backwaves in the context of spiral antennas. However, the invention is not so limited. Various types of antennas, including other types of frequency independent antennas, even simple dipoles, are sometimes mounted in such a way that a tuned-cavity approach would be beneficial, and the present disclosed technique may be employed with any such type of antenna. Indeed, the presently disclosed technique is applicable to antennas generally.

Figure 7:
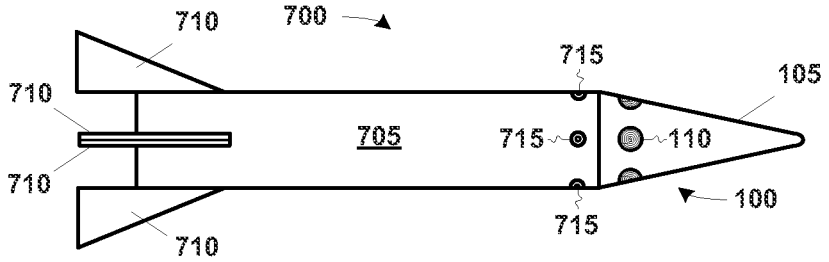
FIG. 7-FIG. 8 illustrate one particular embodiment of an apparatus employing the apparatus of FIG. 1.

In one particular embodiment, the presently disclosed technique a plurality of spiral antennas as described herein are deployed on a vehicle—namely, a missile—in the manner disclosed U.S. Provisional Application Ser. No. 61/230,476, entitled, "Monopulse Spiral Mode Antenna Combining", filed Jul. 31, 2009, in the name of the inventor Brett A. Williams. Thus, in one particular embodiment shown in FIG. 7, the apparatus 100 is a part of a missile 700. The missile 700 comprises a missile body 705 to which the radome 100 is joined. This particular embodiment employs a plurality of conformal, spiral antennae 110 (only one indicated), but the presently disclosed technique contemplates variation in this respect as well. For example, the variant in FIG. 2B may be used.

The missile 700 also includes means for guiding the missile responsive to information obtained through the spiral antennae 110. The guiding means includes a computer-implemented guidance and navigation control system 800, shown in FIG. 8, and means for affecting the heading of the missile. The affecting means may comprise a plurality of flight control surfaces 710 (e.g., fin surfaces), a plurality of attitude control jets 715, or both.

Figure 8:
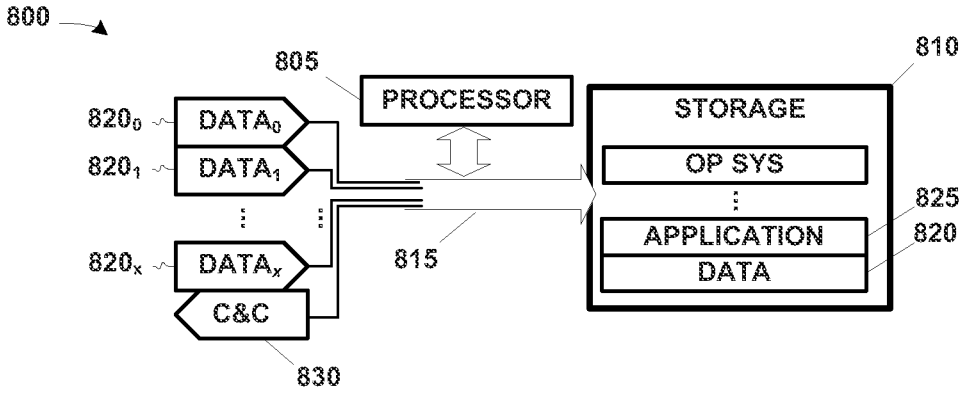

Turning now to FIG. 8, the computer-implemented guidance and navigation control system 800 includes a processor 805 communicating with a storage 810 over a bus 815. Note that, in this particular embodiment, the processor need not necessarily be a microprocessor or electronic controller. It may instead be, for example an appropriately programmed field programmable gate array ("FPGA") or an application specific integrated circuit ("ASIC"). It also includes a plurality of data channels $\mathbf{820}_0$-$\mathbf{820}_x$ over which it receives data from the spiral antennae 110 and, if present other sensors. The application 825 operates on the data 820 to determine course adjustments to keep the missile 700 on target and issues command and control ("C&C") signals 830 to the guiding means to effect that goal. The manner in which the application 825 determines course adjustments will be implementation specific.

Thus, in one particular embodiment, the presently disclosed technique deploys the apparatus 100, shown in FIG. 1, in implementing a method for use in operating a missile, comprising transmitting and receiving signals through a plurality of conformal, spiral antennae 110 mounted in a radome 105. In one particular embodiment, it then guides the missile 700, shown in FIG. 7, from information obtained from signals received through the antennae.

The phrase "capable of" as used herein is a recognition of the fact that some functions described for the various parts of the disclosed apparatus are performed only when the apparatus is powered and/or in operation. Those in the art having the benefit of this disclosure will appreciate that the embodiments illustrated herein include a number of electronic or electro-mechanical parts that, to operate, require electrical power. Even when provided with power, some functions described herein only occur when in operation. Thus, at times, some embodiments of the apparatus of the invention are "capable of" performing the recited functions even when they are not actually performing them—i.e., when there is no power or when they are powered but not in operation.

The following documents are hereby by incorporated by reference as if set forth herein verbatim for the noted purposes:

- U.S. Provisional Application Ser. No. 61/242,429, entitled "Highly Agile Wideband Cavity Impedance Matching", filed Sep. 15, 2009, in the name of the inventors Brett A. Williams, et al., and commonly assigned herewith for all purposes;
- U.S. Pat. No. 6,407,721, entitled "Super Thin, Cavity Free Spiral Antenna", issued Jun. 18, 2002, to Raytheon Co. as assignee of the inventors Mike Mehen et al., for its teachings regarding spiral antennas as modified in U.S. Application Ser. No. 61/242,429;
- U.S. patent application Ser. No. 11/288,639, entitled "Evanescent Wave Coupling for Fresnel Direction Finding", filed Nov. 29, 2005, in the name of the inventor Brett A. Williams, for its teachings regarding evanescent wave coupling;
- U.S. patent application Ser. No. 11/616,639, entitled "Subwavelength Aperture Monopulse Conformal Antenna", filed Dec. 27, 2006, in the name of the inventor Brett A. Williams, for its teachings regarding evanescent wave coupling;
- U.S. Provisional Application Ser. No. 61/052,810, entitled, "Radio Frequency Photonic Transceiver", filed May 13, 2008, in the name of the inventors Brett A. Williams and Kurt S. Schuder for its teachings regarding photonic elements; and U.S. Provisional Application Ser. No. 61/230,476, entitled, "Monopulse Spiral Mode Antenna Combining", filed Jul. 31, 2009, in the name of the inventor Brett A. Williams for its teachings regarding the deployment and utilization of spiral antennas.

U.S. Pat. No. 5,929,430, entitled "Coupled Opto-electronic Oscillator", issued Jul. 27, 1999, to California Institute of Technology as assignee of the inventors X. Steve Yao et al., for disclosure regarding design, construction, and operation of photonic devices;

U.S. Pat. No. 6,389,197, entitled "Coupling System to a Microsphere Cavity", issued May 14, 2002, to California Institute of Technology as assignee of the inventors Vladimir Iltchenko et al., for disclosure regarding design, construction, and operation of photonic devices;

U.S. Pat. No. 6,473,218, entitled "Light Modulation in Whispering-Gallery-Mode Resonators", issued Oct. 29, 2002, to California Institute of Technology as assignee of the inventors Lute Maleki et al., for disclosure regarding design, construction, and operation of photonic devices;

U.S. Pat. No. 7,133,180, entitled "Resonant Impedance Matching in Microwave and RF Device", issued Nov. 7, 2006, to OEwaves, Inc., as assignee of the inventors Vladimir Iltchenko et al., for disclosure regarding design, construction, and operation of photonic devices; and U.S. application Ser. No. 11/421,504, entitled "Millimeter Wave Electonically Scanned Antenna", filed Jun. 1, 2006, in the name of Cole A. Chandler, and commonly assigned herewith, for disclosure regarding design, construction, and operation of RF microstrips.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A microwave-photonic device for removing a backwave from a radiating device spiral antenna, comprising:

a tuner configured to tune the microwave-photonic device to receive backwave radio frequency (RF) energy at a selected RF band from the radiating device spiral antenna;

an electro-optically active material;

means for communicating laser light to the electro-optically active material;

a photodiode;

means for communicating electromagnetic products of interactions between radiation and laser light to the photodiode; and means for communicating outputs of the photodiode to a ground to eliminate the backwave RF energy.

2. The microwave-photonic device of claim 1, wherein the electromagnetic products of interactions between radiation and laser light enter a series of electro-optically active materials subsequent to the first.

3. The microwave-photonic device of claim 1, further comprising a horseshoe conductor on a surface of the electro-optically active material, the horseshoe conductor coupled to a wire/microstrip/stripline.

4. The microwave-photonic device of claim 1, wherein the means for communicating laser light to the electro-optically active material comprises a prism.

5. The microwave-photonic device of claim 1, wherein the means for communicating the electromagnetic products of interactions between radiation and laser light to the photodiode comprises freespace optics that guide light out of the electro-optically active material to the photodiode.

6. The microwave-photonic device of claim 1, wherein the means for communicating the outputs of the photodiode to the ground comprises copper wire, a micro strip, or a stripline.

7. A method for removing a backwave from a radiating device spiral antenna, comprising:

tuning an electro-optically active material to receive backwave radio frequency (RF) energy at a selected RF band;

receiving, by the electro-optically active material, the backwave RF energy at the selected band from the radiating device spiral antenna;

communicating laser light to the electro-optically active material;

communicating electromagnetic products of interactions between the radiation and the laser light to a photodiode; and communicating outputs of the photodiode to a ground to eliminate the backwave RF energy.

8. A microwave-photonic device, comprising:

an electro-optically active material;

a tuner configured to tune the electro-optically active material to receive backwave radio frequency (RF) energy at a selected RF band from a radiating device spiral antenna;

a conductor capable of communicating the backwave RF energy at the selected RF band to the electro-optically active material;

a prism through which laser light is communicated to the electro-optically active material;

a photodiode;

means for communicating electromagnetic products of interactions between radiation and laser light to the photodiode; and means for communicating outputs of the photodiode to a ground to eliminate the backwave RF energy.

9. The microwave-photonic device of claim 8, wherein the means for communicating the electromagnetic products of interactions between radiation and laser light to the photodiode comprises freespace optics that guide light out of the electro-optically active material to the photodiode.

10. The microwave-photonic device of claim 8, wherein the means for communicating the outputs of the photodiode to the ground comprises copper wire, a micro strip, or a stripline.

11. An apparatus, comprising:

a radiating device spiral antenna; and a microwave-photonic device for suppressing backwave radio frequency (RF) energy at a selected RF band from the radiating device spiral antenna, the microwave-photonic device comprising:

an electro-optically active material;

a tuner configured to tune the electro-optically active material to receive backwave RF energy at a selected RF band from a radiating device the spiral antenna;

a conductor capable of communicating the backwave RF energy at the selected RF band to the electro-optically active material;

a prism through which laser light is communicated to the electro-optically active material;

a photodiode;

a light guide configured to communicate electromagnetic products of interactions between radiation and laser light to the photodiode; and a conductor configured to communicate outputs of the photodiode to a ground to eliminate the backwave RF energy.

12. The apparatus of claim 11, wherein the radiating device spiral antenna comprises a plurality of spirals.

13. An antenna, comprising:

a spiral radiating device element; and a microwave-photonic device for suppressing backwave radio frequency (RF) energy at a selected RF band from the spiral radiating device element, the microwave-photonic device comprising:

an electro-optically active material;

a tuner configured to tune the electro-optically active material to receive backwave RF energy at a selected RF band from the spiral radiating device element;

a conductor capable of communicating the backwave RF energy at the selected RF band to the electro-optically active material;

a prism through which laser light is communicated to the electro-optically active material;

a photodiode;

a light guide configured to communicate electromagnetic products of interactions between radiation and laser light to the photodiode; and a conductor configured to communicate outputs of the photodiode to a ground to eliminate the backwave RF energy.

14. The antenna of claim 13, wherein the spiral radiating device element comprises a plurality of spirals.

15. A missile, including:

a spiral antenna mounted on the missile;

a backwave suppression mechanism for suppressing backwave radio frequency (RF) energy at a selected RF band from the spiral antenna, comprising:

an electro-optically active material;

a tuner configured to tune the electro-optically active material to receive the backwave RF energy at the selected RF band from the spiral antenna;

a conductor capable of communicating the backwave RF energy at the selected RF band to the electro-optically active material;

a prism through which laser light is communicated to the electro-optically active material;

a photodiode;

a light guide configured to communicate electromagnetic products of interactions between radiation and laser light to the photodiode; and a conductor configured to communicate outputs of the photodiode to a ground to eliminate the backwave RF energy; and a guidance and navigation control system for guiding the missile responsive to information obtained through the spiral antenna.

* * * * *